US005603906A

United States Patent [19]

Lang et al.

[11] Patent Number: 5,603,906

[45] Date of Patent: Feb. 18, 1997

[54] LOW $NO_x$ BURNER

[75] Inventors: Jerry M. Lang, Lindale; David W. Scott, Garland, both of Tex.

[73] Assignee: Holman Boiler Works, Inc., Dallas, Tex.

[21] Appl. No.: 560,941

[22] Filed: Nov. 20, 1995

Related U.S. Application Data

[63] Continuation of Ser. No. 395,164, Feb. 27, 1995, abandoned, which is a continuation of Ser. No. 34,327, Mar. 22, 1993, abandoned, which is a continuation-in-part of Ser. No. 786,869, Nov. 1, 1991, Pat. No. 5,257,927.

[51] Int. Cl.[6] ..... B01D 53/92

[52] U.S. Cl. ..... 422/182; 110/203; 110/244; 110/342; 422/183; 431/5; 431/115; 431/177

[58] Field of Search ..... 422/182, 183, 422/234; 110/203–207, 244, 342, 344, 345; 431/5, 9, 115, 116, 177, 188; 588/900

[56] References Cited

U.S. PATENT DOCUMENTS

| | | | |
|---|---|---|---|
| 1,920,186 | 8/1933 | Carter | 431/175 |
| 1,987,400 | 1/1935 | Hillhouse | 431/11 |
| 2,210,428 | 8/1940 | Peabody | 239/61 |
| 2,247,768 | 7/1941 | Huwyler | 431/238 |
| 2,660,230 | 11/1953 | Denker et al. | 431/161 |
| 3,391,981 | 7/1968 | Voorheis et al. | 431/185 |
| 3,615,249 | 10/1971 | Martois | 422/183 |
| 3,834,857 | 9/1974 | Hemingway et al. | 431/158 |
| 3,837,813 | 9/1974 | Ebeling et al. | 431/9 |
| 3,856,455 | 12/1974 | Otway et al. | 431/11 |
| 3,904,349 | 9/1975 | Peterson et al. | 431/184 |
| 3,918,886 | 11/1975 | Runninger | 431/184 |
| 3,932,110 | 1/1976 | Waddell | 431/184 |
| 4,004,875 | 1/1977 | Zink et al. | 431/9 |
| 4,007,001 | 2/1977 | Schirmer et al. | 431/10 |
| 4,013,399 | 3/1977 | Craig et al. | 431/351 |
| 4,106,890 | 8/1978 | Fulmer et al. | 431/184 |
| 4,141,505 | 2/1979 | Reich | 239/431 |
| 4,144,017 | 3/1979 | Barsin et al. | 431/10 |
| 4,217,132 | 8/1980 | Burge et al. | 431/9 |
| 4,257,762 | 3/1981 | Zink et al. | 431/177 |
| 4,347,052 | 8/1982 | Reed | 431/188 |
| 4,350,103 | 9/1982 | Poll | 110/264 |
| 4,389,185 | 6/1983 | Alpkvist | 431/164 |
| 4,403,941 | 9/1983 | Okiura et al. | 431/10 |

(List continued on next page.)

OTHER PUBLICATIONS

*$NO_x$ Reduction on Natural Gas–Fired Boilers Using Fuel Injection Recirculation (FIR)—Laboratory Demonstration,* Kevin C. Hopkins, et al (Unpublished paper summarizing presentation at Int'l Power Generation Conference, San Diego, California)., Oct. 6, 1991.

"Several Technologies Available to Cut Refinery $NO_x$", *Oil & Gas Journal* D. Fusselman et al, Nov. 2, 1992., pp. 45–50.

*Primary Examiner*—Timothy McMahon

*Attorney, Agent, or Firm*—Pearne, Gordon, McCoy & Granger

[57] ABSTRACT

A low $NO_x$ burner combustion system which may be adjusted for optimum burn rates, temperature and oxygen levels. The burner incorporates a plurality of gas nozzles which individually inspirate a portion of the combustion air and a spin vane diffuser to rotate and mix the gases within the primary combustion zone. The diffuser is axially adjustable in order to vary the distance between the vane and the first combustion zone while the blades of the diffuser can be angularly adjusted to optimize the rotation and mix of the gases. Air for combustion is supplied through primary, secondary and tertiary passages to create distinct combustion zones for complete combustion. The flow rate of the combustion air is controlled through a damper in accordance with the burn characteristics. Further reductions in noxious emissions are accomplished by recirculating flue gases and mixing such gassed directly with combustion fuel prior to introduction into the combustion chamber through eductor nozzles. Still further reductions are attained by mixing a secondary compound such as water or a chemical into the recirculated flue gases to optimize burn levels thereby reducing emissions.

6 Claims, 3 Drawing Sheets

U.S. PATENT DOCUMENTS

| | | | |
|---|---|---|---|
| 4,412,810 | 11/1983 | Izuha et al. | 431/186 |
| 4,462,788 | 7/1984 | Danko | 431/10 |
| 4,504,216 | 3/1985 | Hagar et al. | 431/183 |
| 4,531,904 | 7/1985 | Sato et al. | 431/10 |
| 4,551,090 | 11/1985 | Leikart et al. | 431/188 |
| 4,572,084 | 2/1986 | Green et al. | 110/261 |
| 4,575,332 | 3/1986 | Oppenberg et al. | 431/9 |
| 4,597,342 | 7/1986 | Green et al. | 110/347 |
| 4,602,571 | 7/1986 | Chadshay | 110/264 |
| 4,626,195 | 12/1986 | Sato et al. | 431/188 |
| 4,629,413 | 12/1986 | Michelson et al. | 431/9 |
| 4,718,359 | 1/1988 | Skoog | 110/264 |
| 4,728,285 | 3/1988 | Kamelreiter et al. | 431/187 |
| 4,836,772 | 6/1989 | LaRue | 431/285 |
| 4,915,619 | 4/1990 | LaRue | 431/284 |
| 4,925,387 | 5/1990 | Locaneto et al. | 431/187 |
| 4,983,118 | 1/1991 | Hovis et al. | 431/115 |
| 4,995,807 | 2/1991 | Rampley et al. | 431/9 |
| 5,044,932 | 9/1991 | Martin et al. | 431/116 |

LOW $NO_x$ BURNER

This is a continuation of application Ser. No. 08/395,164, filed Feb. 27, 1995, now abandoned, which was a continuation of application Ser. No. 08/034,327, filed Mar. 22, 1993, now abandoned, which was a Continuation-In-Part of application Ser. No. 07/786,869, filed Nov. 1, 1991, and issued on Nov. 2, 1993, as U.S. Pat. No. 5,257,927.

BACKGROUND OF THE INVENTION

I. Field of the Invention

This invention relates to a burner having reduced $NO_x$ emissions and, in particular, to a burner wherein flow and mix rates may be varied in accordance with the combustion characteristics and demand rate of the burner. The specific adjustments of an existing burner may be retrofitted to vary for optimization with demand.

II. Description of the Prior Art

Combustion system burners have come under increased scrutiny for the toxic emissions which are a by-product of the combustion process. Depending upon the extent of combustion, carbon monoxide and $NO_x$ may be omitted at unacceptable levels. Carbon monoxide levels can normally be controlled through complete combustion resulting in carbon dioxide. However, three factors contribute to the formation of $NO_x$ in combustion systems. The first and most widely recognized is flame temperature. Most current systems incorporate some method of staging fuel and air to reduce flame concentration and resultant high temperatures. A second factor is excess $O_2$ levels. Higher $O_2$ levels tend to provide more oxygen for combination with nitrogen; however, the higher $O_2$ levels results in excess air which tends to balance the effect of lower temperatures. The laminar mix in most current low $NO_x$ burners requires more $O_2$ for complete combustion. If lower $O_2$ levels are utilized the result is incomplete combustion in the form of carbon monoxide. The third factor is residence time in a critical temperature zone which is virtually ignored in modern burners because reduced time means higher velocities producing unacceptable temperatures.

One common practice for-reducing $NO_x$ levels is to use external, induced or forced flue gas recirculation (FGR). A common misconception about FGR is that the process is destroying $NO_x$ in the original flue gas. However, recent research has determined that FGR simply reduces or dilutes the flame front thereby reducing the formation of $NO_x$. Further, external flue gas recirculation results in higher temperature and increased volume combustion air producing higher pressure drops through the system requiring more horsepower, the resultant higher velocities also reducing heat transfer thereby reducing the efficiency of the burner.

Several burner manufacturers have developed low $NO_x$ systems with mixed results. Although $NO_x$ systems emissions have been reduced many of the systems do not meet the stringent emission levels. Moreover, the modern burners are specifically designed for the particular application and will not control emissions in different combustion systems or under different conditions because of their inflexibility. An additional drawback in prior known systems, as $NO_x$ emissions were reduced the carbon monoxide (CO) levels would increase.

SUMMARY OF THE PRESENT INVENTION

The present invention overcomes the disadvantages of the prior known burner systems by providing a low $NO_x$ burner with an adjustable design for application in many different systems and in response to different operating conditions. As a result the burner of the present invention may be installed as a retro-fit adapter for existing burner systems.

The low $NO_x$ burner of the present invention includes a plurality of coaxial passageways through which combustion gases flow. Primary air flows through an inner passageway within which a spin vane is positioned. The spin vane may be axially adjusted to optimize combustion. The flow of primary air from the forced air windbox into the burner is controlled by a damper having adjustable louvers to further improve combustion. As the primary air passes through the vane, it is caused to spin and mix with the fuel supplied through a series of eductor nozzles radially spaced about the primary combustion zone. The nozzles mix the fuel with secondary combustion air from the windbox prior to eduction into the combustion chamber. Alternatively, recirculated flue gas may be mixed with the fuel in the eductor nozzles. A chamber throat formed of refractory materials forms a secondary combustion zone where reradiation from the refractory throat heats the fuel/air mix and speeds the burning process. A final tertiary burn takes place in a tertiary combustion zone beyond the refractory throat where laminar mixing occurs as a result of the tertiary air supply which bypasses the initial combustion zones. Thus, three distinct combustion zones and two recirculation areas are produced resulting in low $NO_x$ emissions.

The system of the present invention provides improved reduction of $NO_x$ emissions through three distinct means: (1) Recirculation of flue gases for mixing with combustion fuel prior to injection into the combustion chamber; (2) Use of eductor nozzles to mix combustion fuel with recirculated flue gases prior to combustion; and (3) Injection of a chemical or other secondary compound into flue gas inlet. With flue gas temperatures approximating 400° F. the compound injected into the flue gas is vaporized which cools the flue gas resulting in more efficient operation of the eductors and lower flame temperatures. Possible injection compounds include chemicals such as methanol, steam or water, cool air or waste materials.

The present system reduces $NO_x$ emissions without the trade off of increased CO emissions of prior known burners by optimizing the volume and mix of combustion air to the staged combustion zones.

Accordingly, $NO_x$ emission levels are reduced by In turn, the burn temperature and residence time of the combustion gases are controlled through the various adjustments of the burner system. Accordingly, $NO_x$ emission levels are reduced by controlling the $O_2$ levels within the combustion zones, temperature of the recirculated combustion gases and residence time within burner. These parameters are controlled by varying the pitch angle of the diffuser blades, the length of the chamber from the vane diffuser to the fuel jets, and the ratio of primary combustion air flowing through the central passage to secondary and tertiary (if present) combustion air flowing to subsequent combustion zones. In addition, the present system includes internal flue gas recirculation which maintains the temperature of the recirculated gases while ensuring complete combustion. While the adjustable vane reduces CO levels, recirculation through the eductor nozzles reduces $NO_x$ levels.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
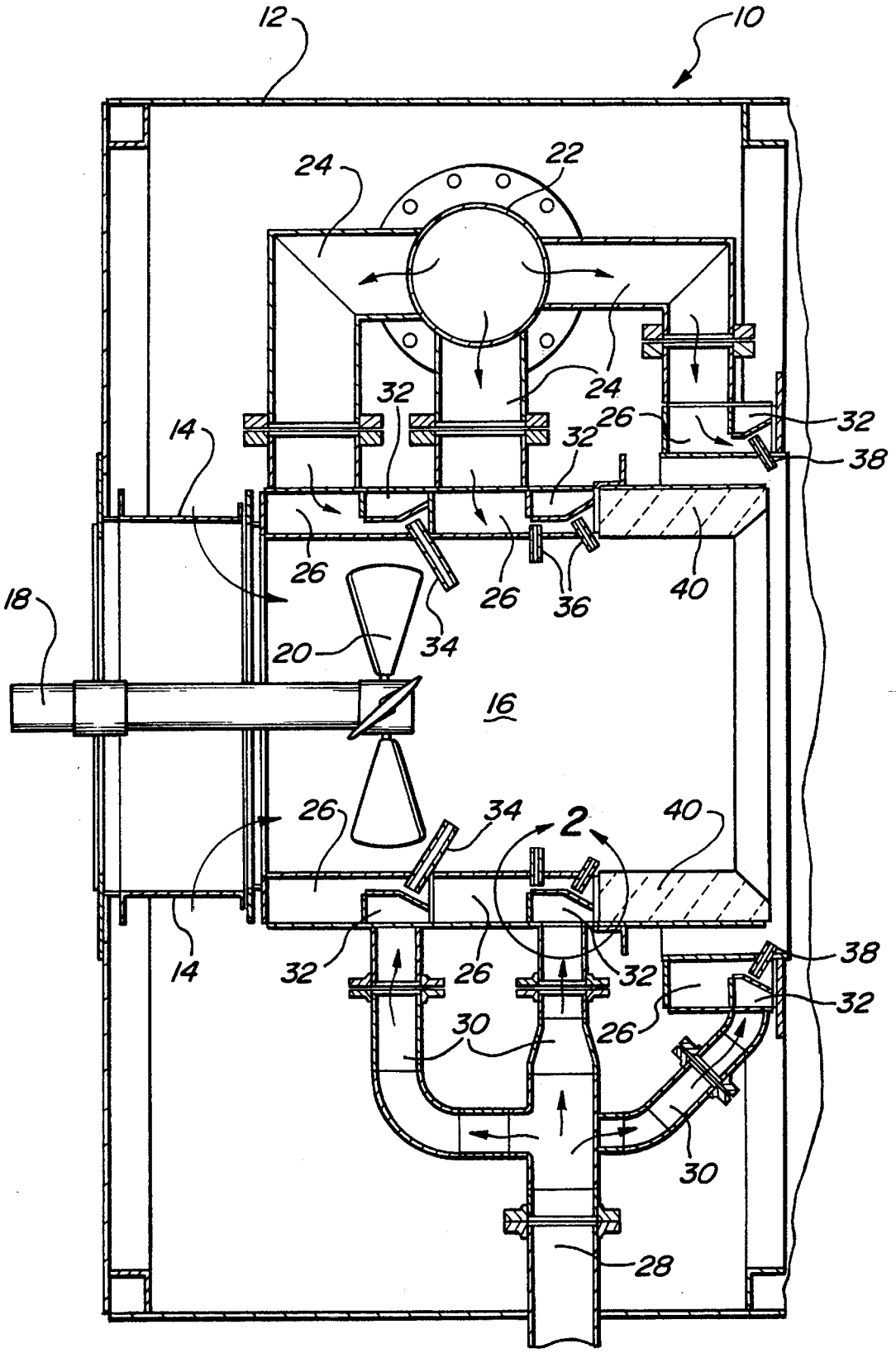
FIG. 1 is a cross-sectional view of a low $NO_x$ burner embodying the present invention.
Figure 3:
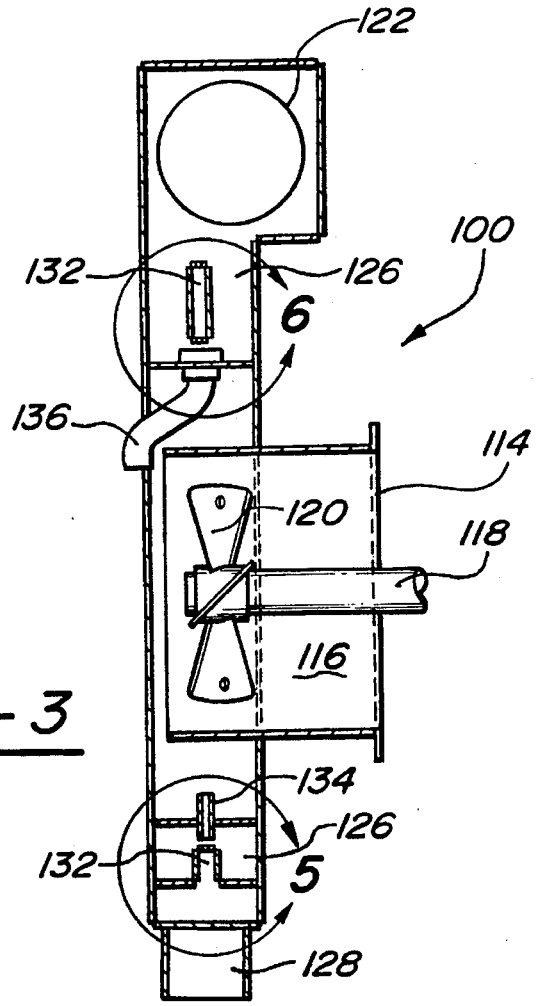
FIG. 3 is a cross-sectional view of an alternative embodiment of the low $NO_x$ burner.
Figure 4:
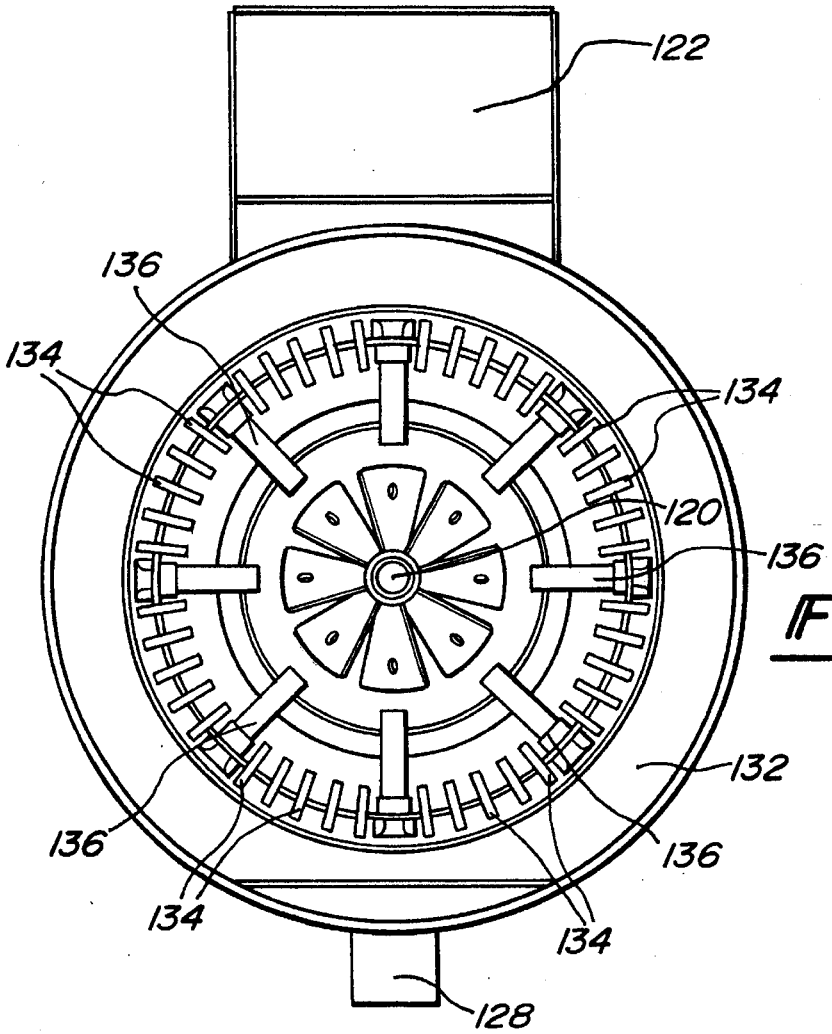
FIG. 4 is an end view thereof.
Figure 5:
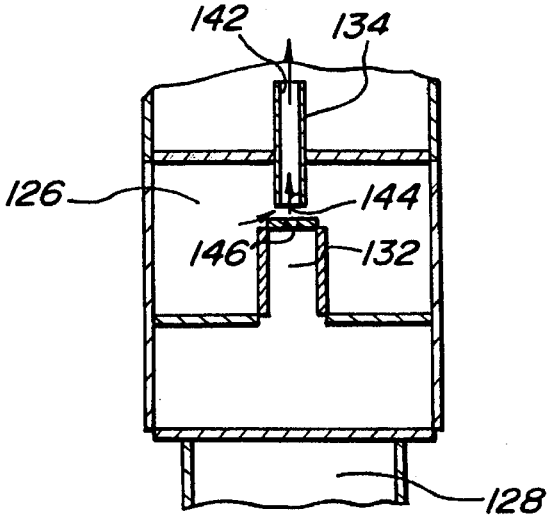
FIG. 5 is an enlarged perspective of the eductor nozzles of FIG. 3 for injecting combustion fuel.
Figure 6:
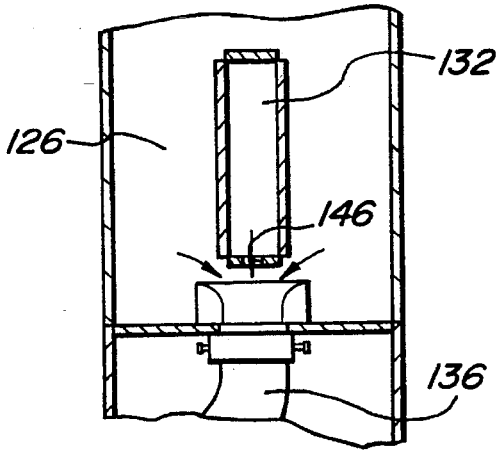
FIG. 6 is an enlarged perspective of the eductor nozzles of FIG. 3 for injecting recirculated flue gases.

Referring to the drawings, there are shown refined embodiments of a low $NO_x$ burner in accordance with the present invention. FIG. 1 shows a high efficiency, low $NO_x$ emission burner 10 while FIG. 3 shows an alternative construction for optimizing recirculation and mix of combustion fuel with recirculated flue gases to reduce $NO_x$ emissions. With the advent of stricter emission standards for all types of combustion systems, the elimination or reduction of noxious emissions such as $NO_x$ and CO becomes increasingly important. The embodiment of the present invention provide a high efficiency burner whereby flame temperature, burn rate, etc. are strictly controlled yet undesirable emissions are substantially reduced. These embodiments of the invention provide still further reductions in emission levels by first ensuring that the recirculated flue gases are mixed with the combustion fuel prior to injection by the eductors and through the introduction of a secondary compound such as water or methanol prior to injection into the combustion chamber.

Figure 2:
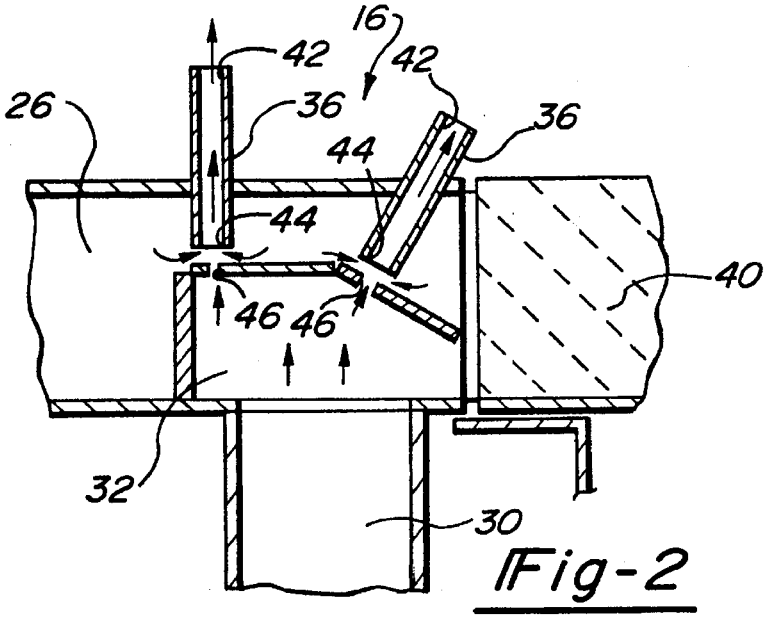
FIG. 2 is an enlarged perspective of the eductor nozzles within circle 2 of FIG. 1.

Referring now to FIGS. 1 and 2, the burner 10 of the present invention includes an outer housing 12 adapted to be bolted or welded to a wall of a boiler or similar structure. The housing 12 directs combustion air from a forced air windbox through adjustable louvers 14 into a central air passage 16. Axially positioned within the air passage 16 is a pipe 18 through which combustion fuel, such as refinery oil or natural gas, may be supplied. A spin vane 20 attached to the pipe 18 imparts a rotational mix on the combustion air flowing across the vane 20 to ensure an optimum mix of combustion air and fuel. In one embodiment of the present invention, the axial position of the spin vane 20 and the angle of the vent blades may be selectively adjusted to optimize burn rates while minimizing emissions such as CO. Additionally, the damper 14 may be selectively adjusted to control the volume of combustion air flowing into the combustion zones in the central passage 16 to further optimize combustion.

In accordance with the present invention, it has been determined that substantial reduction in $NO_x$ emissions can be attained by recirculating flue gases for mixing with combustion fuel prior to injection into the combustion chamber. Since the combustion fuel is supplied under pressure, the mixing must be conducted under compression to achieve the optimum mixture of combustion fuel and recirculated flue gases. By combining the recirculated flue gases with the combustion fuel, the temperature of the combustion mix is increased resulting in an improved burn rate and a more thorough combustion thereby reducing noxious emissions. To this end, the burner 10 includes passageways for delivery of both combustion fuel and recirculated flue gases to the combustion chamber 16.

Flue gases are recirculated through an inlet 22 which communicates with the flue of the burner 10. The flue gases are directed through a plurality of passageways 24 which communicate with annular flue gas chambers 26 extending about the central passage 16. Combustion fuel is supplied through a fuel inlet 28 and diverted through a plurality of passageways 30 to annular combustion fuel chambers 32 extending about the central passage 16. In a preferred embodiment, the annular fuel chambers 32 are disposed within the annular flue gas chambers 26 to facilitate ready communications. Furthermore, the annular chambers are longitudinally spaced along the central passage 16 in accordance with the desired combustion zones of the burner 10. In the example depicted in FIG. 1, three longitudinally spaced chambers are utilized to create primary, secondary and tertiary combustion zones.

A primary combustion zone is created by a first set of eductor nozzles 34 in fluid communication with both the combustion gas chamber 26 and the combustion fuel chamber 32. The first eductor nozzles 34 are circumferentially spaced about the air passage 16 to deliver the mixture of flue gas and fuel into the passage 16 just downstream of the spin vane 20 creating the primary combustion zone.

A secondary combustion zone is created by a second set of eductor nozzles 36 in fluid communication with both the combustion gas chamber 26 and the combustion fuel chamber 32. The second eductor nozzles 36 are circumferentially spaced about the air passage 16 to deliver the mixture of the gas and fuel into the passage 16 downstream of the first eductor nozzles 34 creating the secondary combustion zone.

A tertiary combustion zone is created by a third set of eductor nozzles 38 in fluid communication with both the combustion gas chamber 26 and the combustion fuel chamber 32. The third eductor nozzles 38 are circumferentially spaced at the mouth of the central air passage 16 to deliver the mixture of flue gas and fuel into a tertiary combustion zone. Refractory material 40 lines the combustion chamber 16 to direct combustion through the burner 10.

Operation of the eductor nozzles 34,36,38 is best shown in the enlargement of FIG. 2. The eductor nozzles comprise tubular bodies with an outlet 42 in communication with the combustion chamber 16 and an inlet 44 in communication with both the flue gas chamber 26 and the combustion fuel chamber 32. The combustion fuel is supplied under pressure to the chamber 32. The chamber 32 includes an aperture 46 axially aligned with the eductor nozzle 36 and in close proximity to the inlet 44. The pressure of the combustion fuel directs the fuel through the apertures 46 into the eductor nozzles 36. However, the nozzles 36 are spaced from the chamber 32 creating a gap placing the inlet in direct communication with the flue gas chamber 26. Thus, as combustion fuel flows into the eductor nozzles, recirculated combustion gas is drawn into the eductor nozzles 36 and mixed with the fuel under compression. As a result, a mixture of combustion gas and combustion fuel will be injected into the central air passage 16 by the eductor nozzles 34,36,38. In addition, since the flue gas temperature is approximately 400° F., the temperature of the combustion fuel will be increased prior to combustion. The resulting mix and increase in temperature optimizes the burn rate while substantially reducing noxious emissions such as $NO_x$ and CO.

Further reductions in emissions have resulted from the injection of a chemical or other secondary compound into the flue gas chamber for mixture with the recirculated flue gas. In a preferred embodiment, the secondary compound is injected at the flue gas inlet 22 for mixture/vaporization in the recirculated flue gases. The raised temperature of the flue gas causes vaporization of the secondary compound injected therein. Examples of possible secondary compounds include chemicals such as methanol, steam or water, and chemical waste materials which are combustible. The injection of water has a cooling effect on the flue gas resulting in more efficient operation of the eductors and a lower flame temperature for a more even or complete burn. The flue gas/compound mixture then proceeds to the annular passages 26 for mixture with the combustion fuel as previously described.

FIGS. 3 through 6 show a retrofit version of a burner 100 embodying the principles of the present invention. The retrofit assembly 100 is utilized in replacement of exiting burners on older boilers and the like. The central air passage 116 includes a spin vane 120 mounted to tube 118. Recirculated flue gas is delivered through inlet 122 to an annular flue gas chamber 126 which is in fluid communication with both first eductor nozzles 134 and second eductor nozzles 136. Combustion fuel is supplied through inlet 128 to annular chamber 132 to force combustion fuel through apertures 146 into the eductor nozzles 134,136, recirculated flue gas is drawn into the nozzles for injection into the combustion chamber 116. Thus, the principles of a newly constructed burner can be applied to a retrofit version for installation in existing boiler construction.

The adjustable aspects of the burner system of the present invention are designed to be adjusted for the specific combustion system being employed. The diffuser vane angle, the axial position of the diffuser, and the damper opening can all be individually set in accordance with known parameters of the burner system, namely fuel type, desired temperature, burn rate, etc. This is particularly significant in the retrofit conversion system where the operating parameters have been established. In the present invention, primary combustion occurs at the fuel nozzles 34,134 where initial mix of fuel and air occurs. The products of the primary combustion, which is approximately 60% combustible, enter the refractory lined combustion zone 16,116 where further mix occurs with combustion air from the central air passage 16,116 and the diffuser 20,120. A secondary burn is accomplished in this highly controlled area where the reradiation from the refractory heats the products thereby speeding the burning process which consumes approximately 80% of the remaining combustible products. A final tertiary burn takes place in the furnace area where laminar mixing occurs. Thus, the system produces three distinct combustion zones and recirculation in two areas with resultant low $NO_x$ emissions. The distinct combustion zones are created through the creation of low pressure areas within the burner, namely directly downstream of the vent diffuser 20,120 and at the exhaust of the circumventing air. The low pressure area proximate the diffuser is affected by the pitch of the vane blades—as the vane diffuser is opened the pressure behind the flame is reduced. This requires adjustment of the ratio of primary to secondary or tertiary air through use of the damper 14,114. It is desirable to optimize this ratio to control the air flowing into the burner thereby controlling the $O_2$ levels to produce optimum combustion without excess for the production of $NO_x$ emissions.

The several adjustments of the burner system of the present invention creates a $NO_x$ trim system wherein the emission levels can be optimally controlled along the complete range of demand levels of a modulating burner. The $NO_x$ trim system automatically adjusts the angular and axial position of the vane diffuser to vary the swirl number of the combustion air mix, the ratio of core air to annular air and the $O_2$ levels in the burner across all the demand levels of the burner. These adjustments may be optimally determined across all demand levels of the burner such that as these levels are attained the trim system automatically adjusts the components of the system to reduce emission levels. Typical prior known burners have their emission levels set for operation in a nominal operating range sacrificing emission levels when demand levels fall outside of this range. The several adjustments of the present invention allows continuous automatic control of emission levels at all operating demand levels. Modern burners require continuous monitoring of $NO_x$ levels from the burner. The data from these monitoring systems can be utilized to automatically adjust the $NO_x$ trim system according to the present invention.

In addition to the adjustment features which can be used to optimize burn levels, steps can be taken to further reduce emission levels or, alternatively, to reduce emission levels in fixed or non-adjustable burner systems. Whereas prior known systems have attempted to recirculate flue gases through the combustion chamber, it has been determined that combustion is optimized when flue gases are mixed with combustion fuel prior to introduction into the combustion zones. In the present invention, this mixture occurs through the eductor nozzles which communicate with both the combustion fuel chamber and the flue gas recirculation chamber.

Still further reductions have been noted upon injection of a secondary compound into the flue gas recirculation chamber for mixture with the combustion fuel. Secondary compounds which have resulted in notable reductions in noxious emissions include chemicals such as methanol, steam or water, waste compounds, and cool air. These secondary compounds are vaporized by the 400° F. flue gases. The resulting cooling effect on the flue gas leads to more efficient operation of the eductors and a lower flame temperature. Furthermore, mixture of the secondary compound and/or recirculated flue gases with the combustion air results in significantly lower $NO_x$ levels. However, recirculation with the fuel requires higher levels of compression than with combustion air. The eductor nozzles of the present invention facilitate this by utilizing the pressure differential of the compressed fuel to cause the desired mixing. Thus, the various aspects of the present invention provide significant reductions in noxious emissions including $NO_x$ and CO allowing users to meet increasingly strict emission criteria.

The foregoing detailed description has been given for clearness of understanding only and no unnecessary limitations should be understood therefrom as some modifications will be obvious to those skilled in the art without departing from the scope and spirit of the appended claims.

What is claimed is:

1. In a burner adapted to reduce emission of noxious gases upon combustion of a fuel and air, the burner including a source of combustion fuel, at least a portion of the combustion air flowing through a central air passage into which the combustion fuel is supplied for combustion within a combustion zone of the burner creating combustion gases, the improvement comprising:

an annular combustion fuel passageway radially surrounding said central air passage;

an annular combustion gases passageway radially surrounding said central air passage and being in fluid communication with said combustion fuel passageway;

a plurality of eductor nozzles radially spaced about the central air passage for combining combustion fuel with combustion gases recirculated from the combustion zone, said eductor nozzles having an outlet in fluid communication with said central air passage and an inlet which extends into the combustion fuel passageway, said inlet being in fluid communication with both said combustion fuel passageway and said combustion gases passageway for mixing said combustion fuel with said recirculated combustion gases within said eductor nozzles and directing said mixture into said central air passage for combustion, said combustion fuel and combustion gases being combined prior to mixture with the combustion air and introduction into the combustion zone for optimum combustion and reduction of noxious emissions; and a plurality of staged combustion zones axially spaced along said central air passage, each of said combustion zones having a set of radially spaced eductor nozzles in fluid communication with both said combustion fuel passageway and said recirculated combustion gases passageway for introduction of a mixture of combustion fuel and combustion gases into said staged combustion zones.

2. The improvement as defined in claim 1 and further comprising means for introducing a secondary compound into the mixture of combustion fuel and combustion gases prior to combustion within the combustion zone to optimize combustion flame temperature and further reduce noxious emissions.

3. The improvement as defined in claim 2 wherein said secondary compound is combined with said recirculated combustion gases prior to mixing with said combustion fuel.

4. In a burner adapted to reduce emission of noxious gases upon combustion of a fuel and air, the burner including a source of combustion air and a source of combustion fuel, at least a portion of the combustion air flowing through a central air passage into which the combustion fuel is supplied for combustion within a combustion zone of the burner creating combustion gases, the improvement comprising:

an annular combustion fuel passageway radially surrounding said central air passage;

an annular combustion gases passageway radially surrounding said central air passage and being in fluid communication with said combustion fuel passageway;

means for introducing a secondary compound for mixture with said combustion gases and recirculating said mixture of combustion gases and secondary compound to the combustion zone through said combustion gases passageway;

a plurality of eductor nozzles having an outlet in fluid communication with said air passage and in inlet disposed in the combustion fuel passageway, said inlet being in fluid communication with both said combustion gases passageway and said combustion fuel passageway for combining said recirculated mixture of combustion gases and secondary compound with the combustion fuel; said eductor nozzles outlet directing said combination mixture of combustion gases, secondary compound and combustion fuel into the combustion zone of the burner;

said combustion gases being combined with said secondary compound prior to delivery to said eductor nozzles for combination with said combustion fuel and said combustion fuel, recirculated combustion gases, and secondary compound being combined prior to mixture with the combustion air and introduction into the combustion zone for combustion thereby optimizing combustion and reducing noxious emissions.

5. The improvement as defined in claim 4 wherein said burner includes a flue gas circulation chamber for recirculation of combustion gases from the flue of said burner, said secondary compound being introduced into said flue gas recirculation chamber and said flue gas circulation chamber being in fluid communication with said combustion gases passageway.

6. A process for optimizing combustion within a burner while reducing $NO_x$ emissions as a result of combustion, the process comprising the steps of:

providing a burner including a central air passage and a plurality of eductor nozzles, said eductor nozzles having an outlet in fluid communication with said central air passage and an inlet disposed within a combustion fuel passageway surrounding said central air passage, said inlet being in fluid communication with a combustion fuel supply for delivering combustion fuel into a central air passage for combustion within a combustion zone of the burner;

recirculating combustion gases resulting from combustion within the combustion zone to a flue gas recirculating chamber;

introducing a secondary compound into said flue gas recirculating chamber to form a mixture with said recirculated combustion gases;

delivering the mixture from said flue gas recirculating chamber to a flue gas passageway surrounding said central air passage, said flue gas passageway being in fluid communication with said combustion fuel passageway and said inlet;

introducing said mixture from said flue gas passageway into said combustion fuel passageway; and combining said mixture with said combustion fuel in said eductor nozzles prior to delivery into the central air passage for combustion whereby $NO_x$ emissions from combustion of said mixture within the burner are reduced.

* * * * *

UNITED STATES PATENT AND TRADEMARK OFFICE

CERTIFICATE OF CORRECTION

PATENT NO. : 5,603,906

DATED : February 18, 1997

INVENTOR(S) : Lang et al.

It is certified that error appears in the above-indentified patent and that said Letters Patent is hereby corrected as shown below:

Column 1, line 42, delete "for-reducing" and insert --for reducing--.

Column 2, line 43, delete "Accordingly, $NO_x$ emission levels are reduced by".

Signed and Sealed this

Fifteenth Day of July, 1997

Bruce Lehman

*Attest:*

BRUCE LEHMAN

*Attesting Officer*

*Commissioner of Patents and Trademarks*